US006070274A

United States Patent [19]

van der Sleesen

[11] Patent Number: 6,070,274

[45] Date of Patent: Jun. 6, 2000

[54] PROTECTIVE GARMENTS WITH FLOATING ARMOR AND REDUCED BULK

[75] Inventor: Michael F. van der Sleesen, West Hartford, Conn.

[73] Assignee: Vanson Leathers, Inc., Fall River, Mass.

[21] Appl. No.: 09/156,917

[22] Filed: Sep. 18, 1998

[51] Int. Cl.[7] ..... A41D 1/00

[52] U.S. Cl. ..... 2/456; 2/DIG. 1; 2/97

[58] Field of Search ..... 2/96, 97, 456, 2/DIG. 1, 93

[56] References Cited

U.S. PATENT DOCUMENTS

| | | | |
|---|---|---|---|
| D. 289,941 | 5/1987 | Felder | 2/93 |
| 5,341,514 | 8/1994 | Dale | 2/96 |
| 5,507,042 | 4/1996 | van der Sleesen | 2/69 |
| 5,704,064 | 1/1998 | van der Sleesen | 2/69 |
| 5,752,277 | 5/1998 | van der Sleesen | 2/69 |

*Primary Examiner*—Bibhu Mohanty
*Attorney, Agent, or Firm*—McDermott, Will & Emery

[57] ABSTRACT

A protective garment for use when riding or racing motorcycles or other vehicles in which the rider is exposed and may require aerodynamic advantages. The garment, in one aspect, includes floating armor elements which protect the wearer's body when the garment is being dragged along or against an impact surface. The armor elements can be either removably or permanently attached to the lining. In another aspect, the garment can include a bulk-reducing closure element which forces the garment, when closed, into an aerodynamic profile which is relatively easy and comfortable to maintain because of reduced bulk. The garments can include air permeable vent openings and adjustable, air-impermeable vent covers.

29 Claims, 5 Drawing Sheets

PROTECTIVE GARMENTS WITH FLOATING ARMOR AND REDUCED BULK

FIELD OF THE INVENTION

The present invention relates to protective garments designed for use by, for example, motorcycle riders.

BACKGROUND OF THE INVENTION

The protective gear worn by motorcycle riders should be relatively rugged to protect the rider in the event of a spill from the vehicle at high speeds. Such protective gear preferably includes not only a helmet to protect the rider's head from injury, but also garments or outerwear which provide protective coverings for the rider's torso, arms and legs to prevent or minimize injuries that might arise from abrasion and laceration. Materials for the protective outerwear should be durable and rugged, yet relatively flexible and lightweight, aerodynamic, and asthetically appealing.

U.S. Pat. Nos. 5,704,064, 5,507,042, 5,752,277 and 5,596,769, issued to van der Sleesen and assigned to the assignee of the present invention, disclose representative protective garments for motorcycle riders.

Although such garments are preferably made of a durable material, such as leather, additional protection may be conferred to the rider by including protective armor or shielding in portions of the garments which cover vulnerable areas of the rider's body, such as, for example, the elbows, knees, shoulders, ribs, stomach, and lower back. In the prior art, such protective armor is typically permanently attached to the inside or outside of the garment in the desired locations, or it is removably inserted into specially designed pockets on the garment. Materials for the protective armor are typically lightweight, durable and relatively rigid.

Such protective gear, although advisable for rider safety, tends to be relatively heavy, bulky and hot, and many riders choose not to ride in it.

Vented protective garments were developed in an attempt to overcome the problem of overheating. In such a garment, the rider is not only protected from abrasions in the event of a spill, but is also cooled by air flowing into and through the garment.

One-piece vented protective suits were also developed to protect the rider over his entire body, while also providing cooling airflow to various portions of the body through the suit. Such suits typically are entered through a front zipper or closure element which extends roughly from the collar to the crotch area.

Unfortunately, these protective garments are still relatively bulky and uncomfortable for the rider to wear. The wearer's movements are somewhat restricted when he is wearing the protective garment, due to the ruggedness and relative bulk of the garment, especially if the garment includes protective armor plates or inserts. Also, unless the protective armor is properly located, it may not protect the rider if he suffers a spill and falls on a portion of his body not covered by the armor. Therefore, for comfort, the rider may still choose to avoid wearing the necessary protective garments, especially on warm days or when he is only riding a short distance. Anytime the rider fails to don protective gear, however, the risk of at least superficial injuries increases significantly.

It would therefore be advantageous to provide a protective garment for motorcycle riders which is sufficiently durable and lightweight to protect the rider without being excessively bulky, hot or uncomfortable.

SUMMARY OF THE INVENTION

The present invention provides, in one aspect, a protective garment which incorporates a "floating" protective armor or shielding that can move with the rider as needed inside the garment in the event of a spill. In another aspect of the invention, the protective garment is designed for reduced bulk. Both types of garment can include venting for increased versatility and comfort.

According to one aspect of the invention, there is provided a protective garment, comprising an outer panel, a stretchable lining underlying and peripherally attached to the outer panel, and one or more protective shield members attached to the lining at preselected locations and spaced from the periphery of the lining and movable with the lining relative to the overlying panel.

According to another aspect of the invention, there is provided a protective garment, comprising a front panel, a rear panel joined to the front panel, a stretchable lining underlying and peripherally attached to at least one of the front and rear panels, and one or more protective shield members attached to the lining at preselected locations and spaced from the periphery of the lining. The shield members are movable with the lining relative to its overlying panel.

According to another aspect of the invention, there is provided a protective garment, comprising an outer panel, and at least one closure element disposed at other than the front center of the garment. In one embodiment, the at least one closure element is disposed at a side of the outer panel. In another embodiment, a closure element is disposed at each side of the outer panel.

According to still another aspect of the invention, there is provided a protective garment, comprising an outer panel, and a bib panel which is adapted to engage with the outer panel with a plurality of closure elements disposed at other than the front center of the garment. In a preferred embodiment, the bib panel is disposed in the front of the garment. Engagement of the panels reduces the height, and increases the curvature, of the garment relative to the height and curvature of the garment when the panels are not engaged. This urges a wearer of the garment into a corresponding, relatively aerodynamic profile when the garment is closed about the wearer.

At least one of the front and rear panels of the garment can include at least one vent opening for passage of air therethrough, wherein the vent opening is spanned by an air-permeable material. The air-permeable material spanning the vent opening is preferably substantially non-stretchable. In the lined garment, the lining is preferably substantially air-permeable in the vicinity of the vent openings.

The vented garment with the off-center closure element can include a stretchable lining underlying and peripherally attached to at least one of the panels, and one or more protective shield members attached to the lining at preselected locations and spaced from the periphery of the lining. The shield members are movable with the lining relative to its overlying panel.

The garment can further include an adjustable air-impermeable vent cover disposed over the vent opening for controlling the passage of airflow through the vent opening. The vent cover can include an interior storage compartment and may further be removable from the garment.

The protective shield members can be either permanently or removably attached to the lining.

The garment can also include an expandable gusset between the front and rear panels.

The garment may be, for example, a jacket, a vest, leggings, chaps, gloves or a full body suit.

These and other objects and advantages of the invention will in part be obvious and will in part appear hereinafter. The invention accordingly comprises the apparatus possessing the construction, combination of elements and arrangement of parts which are exemplified in the following detailed disclosure, the scope of which will be indicated in the claims.

BRIEF DESCRIPTION OF THE DRAWINGS

For a fuller understanding of the nature and objects of the present invention, reference should be had to the following detailed description taken in connection with the accompanying drawings, in which.

Like elements in the FIGURES are indicated by like reference numerals.

DETAILED DESCRIPTION OF THE DRAWINGS

Figure 1:
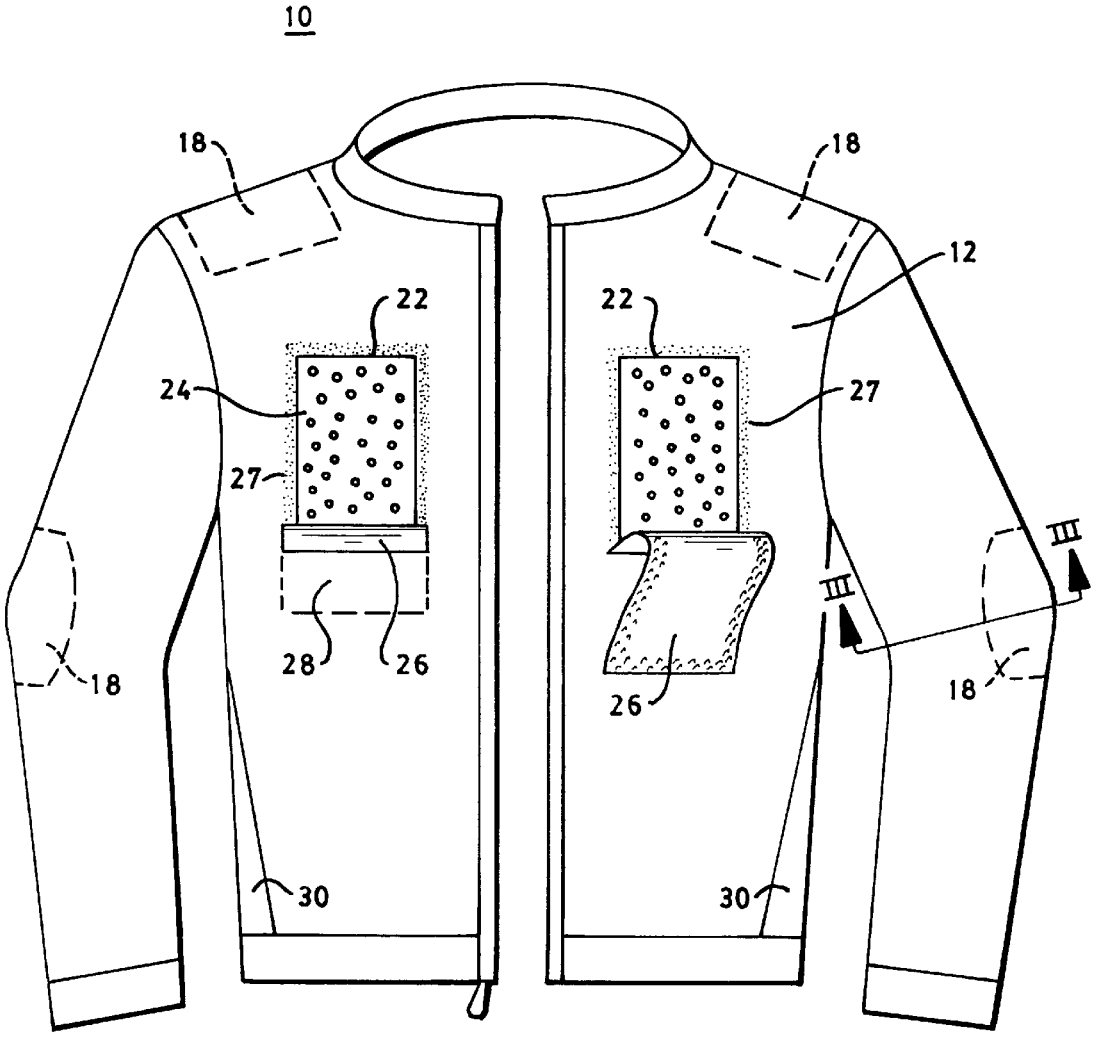
FIG. 1 is a front view of a protective garment according to one aspect of the invention.
Figure 2:
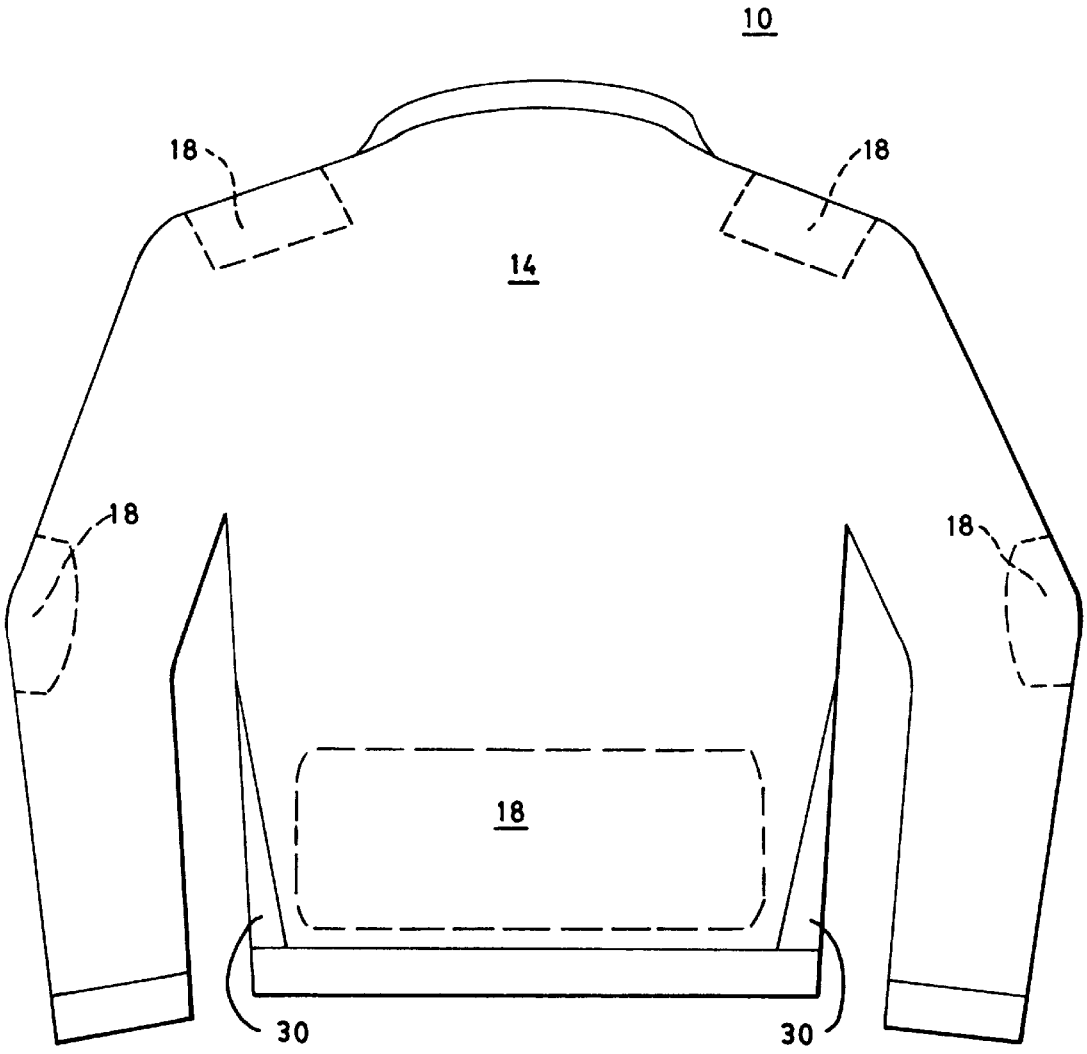
FIG. 2 is a rear view of the protective garment of FIG. 1.

A protective garment according to one aspect of the invention is shown in FIGS. 1 and 2. The garment illustrated in FIGS. 1 and 2 includes a front panel 12 and a rear panel 14 joined to the front panel. The front panel may be split, as shown in FIG. 1, to provide access into the garment. The garment is preferably made of a suitable durable material, such as leather or other heavy fabric.

Figure 3:
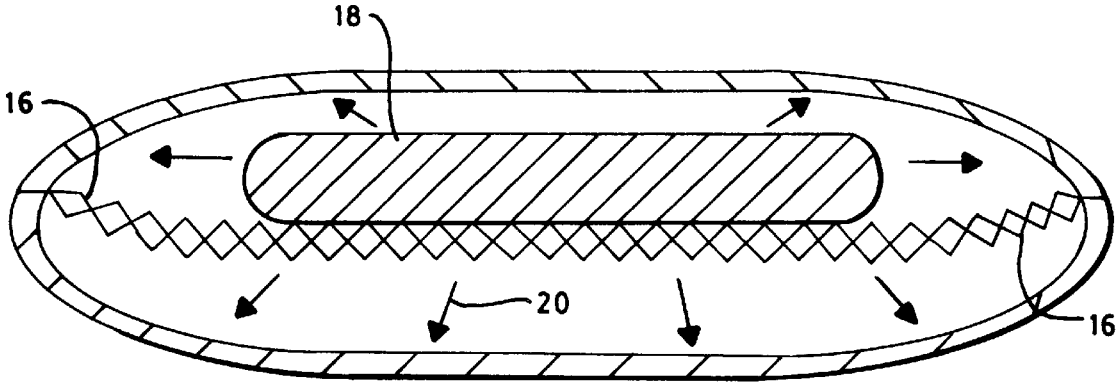
FIG. 3 is a sectional view of a portion of the protective garment of FIG. 1, taken along section line III—III.

The garment includes a stretchable inner lining or sub-panel 16, shown most clearly in FIG. 3. The lining 16 is attached to the front and rear panels 12, 14 at peripheral edges of the panels. One or more protective shield members 18 is attached to the lining 16 between the lining and the inside of the panels, as shown most clearly in FIG. 3.

Because the lining 16 is stretchable and is not attached to the front and rear panels of the garment at the locations of the shield members 18, the shield members which are attached to the lining are relatively free to move, or float, with the lining in any direction, indicated by arrows 20, with respect to the overlying outer panels, in response to contact with portions of the rider's body. The ability of the protective shield members 18 to float relative to the garment panels allows the shield members to move as needed with the rider's body in the event of a spill, instead of remaining immovable and failing to offer the necessary protection to the rider when he most urgently requires it.

The garment may include one or more vent openings 22 for admitting air into and out of the garment, as shown in FIG. 1. The vent openings 22 are preferably spanned by an air-permeable material 24, such as a mesh or otherwise perforated material which admits air into and out of the garment. In one preferred embodiment, the air-permeable material is substantially non-stretchable and therefore provides structure to the garment without changing the fit. A preferred non-stretchable, air-permeable material is perforated leather, but other suitable materials are within the scope of the invention. Preferably, the perforations are relatively small compared to the interperforation spacing. In other forms of the invention, stretchable air-permeable materials can be used, although such forms permit distortions of the nominal shape of the garment.

Figure 4:
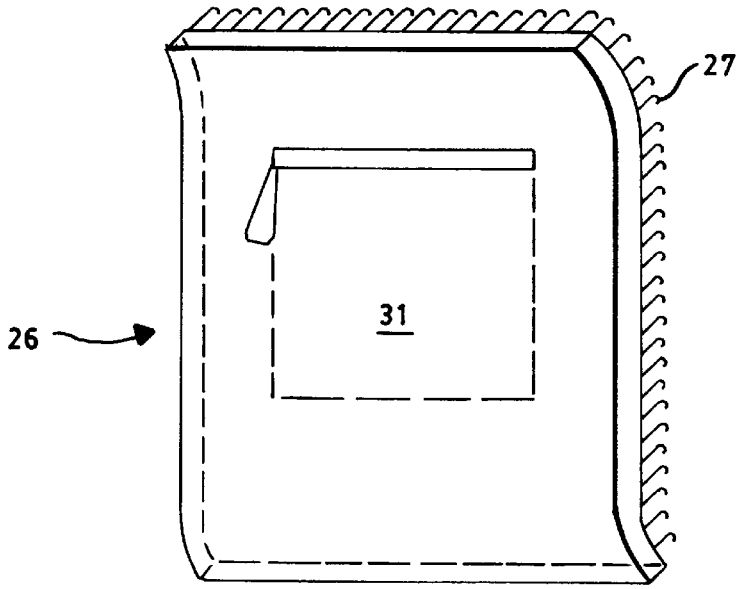
FIG. 4 is a perspective view of a removable cover for a vent in the protective garment of the invention.

The vent openings 22 of the garment may be covered with selectively adjustable air-impermeable vent covers 26, shown in FIG. 1. The vent covers 26 may be located on the outside of the garment or on the inside, depending on the design of the garment and the need for an aerodynamic outer surface. The vent covers 26 are preferably attached to the garment with a closure element 27, such as a zipper or a hook and loop fastener. The vent covers 26 are adjustably placed over the vent openings 22 to regulate the air flowing into and through the garment, thereby regulating the cooling of the wearer. They may be tucked into an interior or exterior pocket 28 when not covering the vent openings, as shown in FIG. 1. Alternatively, the vent cover 26 may be entirely removable from the garment, as shown in FIG. 4. The vent cover 26 may include an interior storage compartment 30 and may be entirely removable from the garment, as shown in FIG. 4. If removable, the vent cover 26 can also function as a wallet for keys, money and other relatively small objects.

The garment 10 is illustrated as a jacket in FIGS. 1 and 2, but the inventive concepts described herein are applicable to any type of garment, including, for example, pants, vests, leggings, chaps, gloves, and full-body suits.

The protective shield members 18 may be located at regions of particular vulnerability on the rider's body, such as, for example, over the elbows, knees, shoulders, lower back, floating ribs, stomach or other areas of the body. They may be permanently attached to the lining 16, or they may be removably attached to the lining, such as with hook and loop fasteners (not shown). As shown in FIGS. 1 and 2, the garment may further include an expandable gusset 30 which is made of a stretchable or expandable material and which serves to provide extra room in the garment. The garment can be cinched up by collapsing the gusset.

The protective shield members are preferably made of a durable, lightweight polymeric material, such as polypropylene.

Because the protective shield members are mounted to a stretchable lining on the inside of the garment, they are free to move or float relative to the front and rear panels of the garment. Thus, if the rider takes a spill and the garment drags along the ground, the shield members inside the garment are not attached to the garment and are not constrained to move with the garment. This is especially important if the rider is being dragged along an abrasive impact surface, such as pavement. With the floating armor of the present invention, the protective shield members can move as needed to be in contact with the portions of the rider's body that may require protection from the impact surface.

Figure 5:
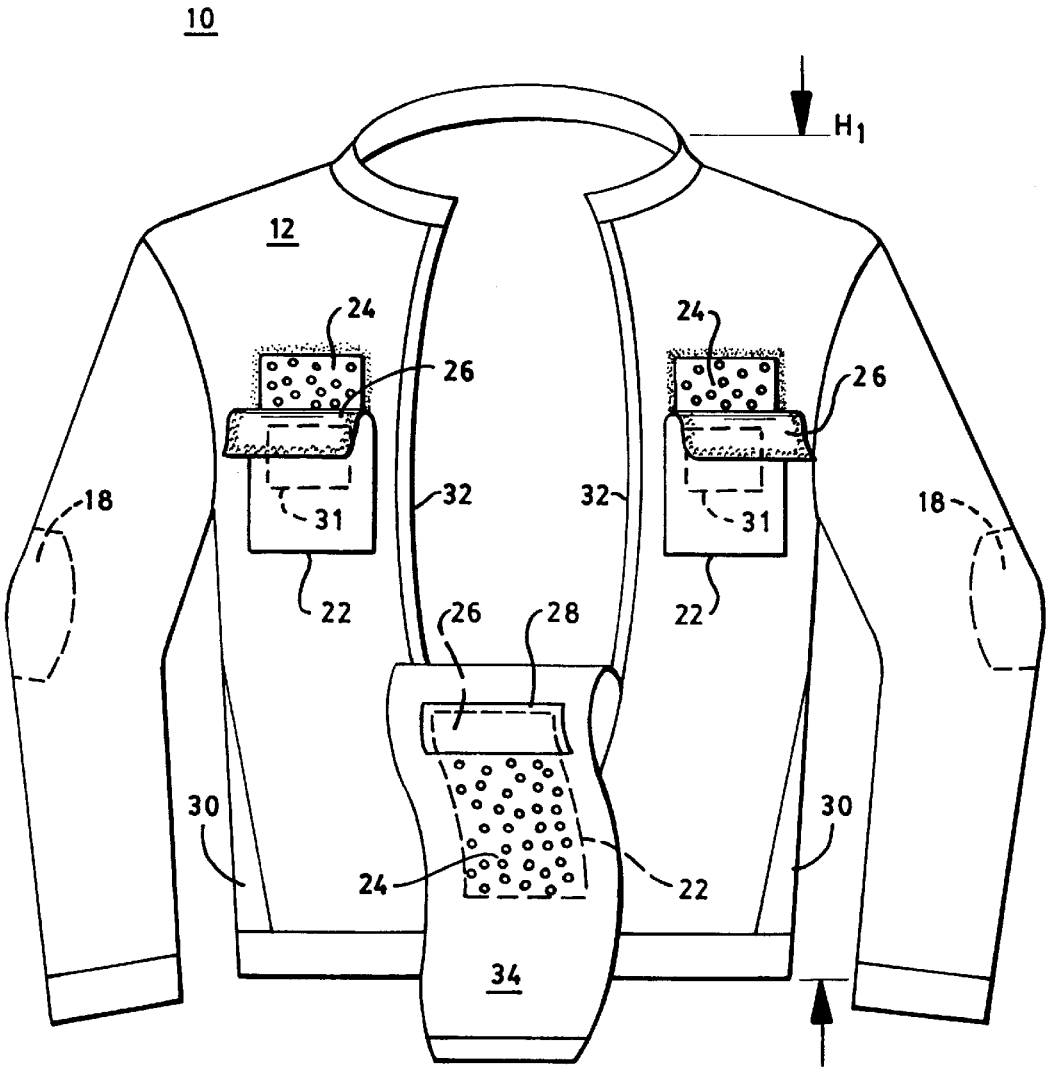
FIG. 5 is a front view of a protective garment according to another aspect of the invention.
Figure 6:
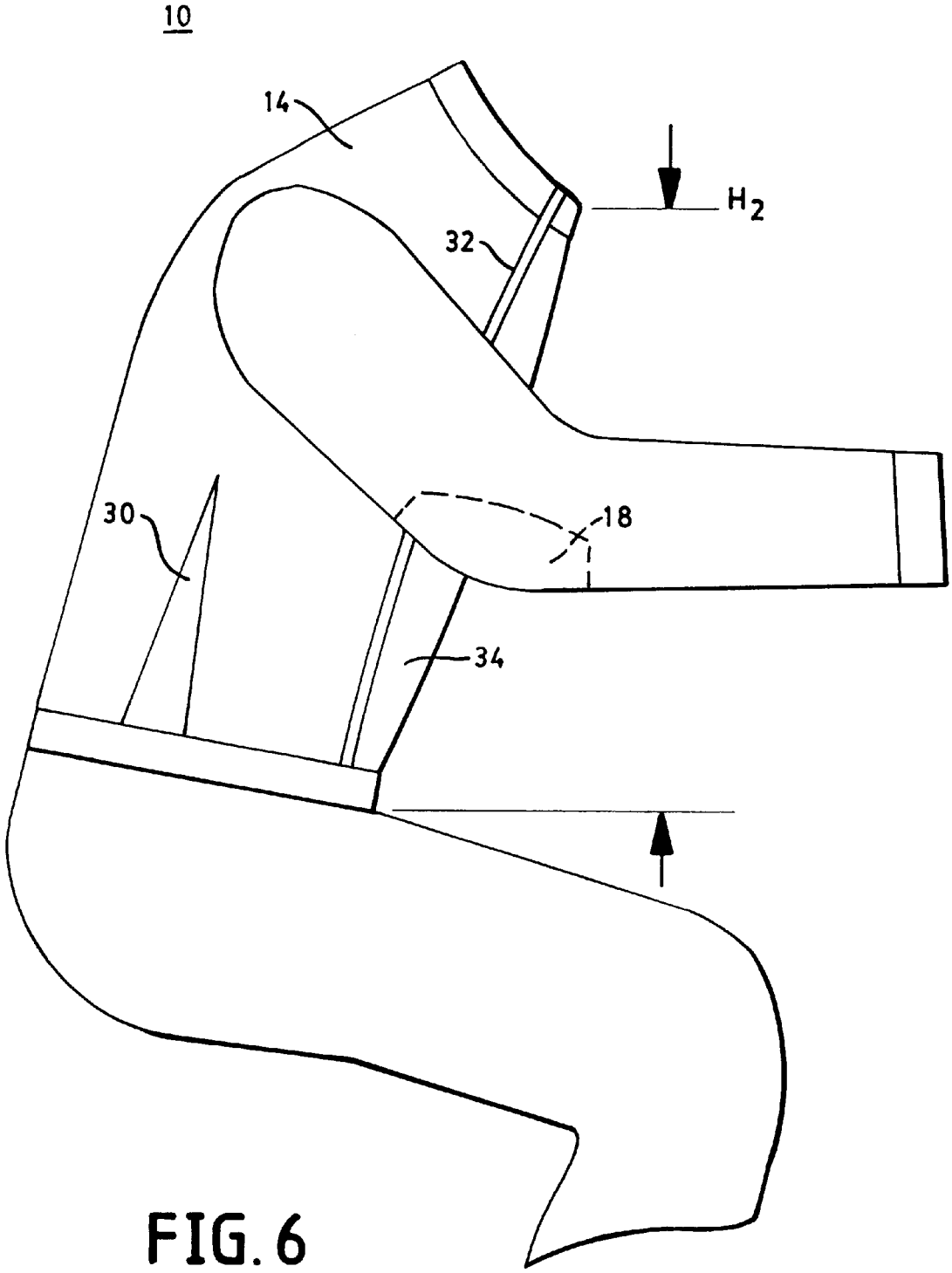
FIG. 6 is a side view of the protective garment of FIG. 5.

FIGS. 5 and 6 illustrate a protective garment according to another aspect of the invention. The garment 10 includes a front panel 12 and a rear panel 14 joined to the front panel. Although illustrated as a full-body suit in FIGS. 5 and 6, the garment can be, for example, a jacket, vest, trousers or other protective garment, as previously mentioned.

The garment 10 includes a closure element 32 for closing the panels about a wearer. When this closure element is engaged with the panels so that they are closed about the wearer, the overall height of the garment is reduced relative to the height of the opened garment. Similarly, the curvature of the garment is more pronounced when the panels are closed about the wearer, as shown by the relative heights H1 and H2 in FIGS. 5 and 6, where H1>H2. The closure element 32 preferably operates to reduce the bulk of the garment by forcing the closed garment into a curved profile that conforms to the profile the wearer would naturally assume when he is riding the vehicle while wearing the garment, as shown in FIG. 6. The closure element 32 follows a curved track along the front of the garment, as illustrated in FIG. 5, and this configuration forces the garment, when closed about the wearer, to assume a C-shaped profile that is aerodynamically and thermally beneficial for the rider.

FIG. 5 illustrates a bib-type front 34 for the garment, defined by two closure elements 32 that extend from the collar area of the garment to at least the waist or crotch area or perhaps lower. When the bib is zipped up, the garment is closed and conforms to a curve that is suitable for aerodynamic performance as well as air-cooling of the wearer. Other configurations for the closure element are considered to be within the scope of the invention. For example, the garment might include only a single closure element which extends along the side of the garment between the front and rear panels, or which extends asymmetrically along the front of the garment.

Other features mentioned in connection with the garment of FIGS. 1–4, such as the vent openings, vent covers, and protective shield members and stretchable lining, may also be included in the garment of FIGS. 5–6.

Because certain changes may be made in the above apparatus without departing from the scope of the invention herein disclosed, it is intended that all matter contained in the above description or shown in the accompanying drawings shall be interpreted in an illustrative and not a limiting sense.

I claim:

1. A protective garment, comprising:

an outer panel;

a stretchable lining underlying and peripherally attached to the outer panel; and one or more protective shield members attached to the lining at preselected locations and spaced from the periphery of the lining and movable with the lining relative to the outer panel.

2. A protective garment according to claim 1, wherein the garment is selected from the group consisting of jackets, vests, leggings, chaps, gloves and full body suits.

3. A protective garment according to claim 1, wherein the outer panel includes at least one vent opening for passage of air therethrough, wherein the vent opening is spanned by an air-permeable material, and wherein the lining is substantially air-permeable in the vicinity of the vent opening.

4. A protective garment according to claim 3, wherein the air-permeable material spanning the vent opening is substantially non-stretchable.

5. A protective garment according to claim 3, further comprising an adjustable air-impermeable vent cover disposed over the vent opening for controlling the passage of air through the vent opening.

6. A protective garment according to claim 5, wherein the vent cover includes an interior storage compartment.

7. A protective garment according to claim 6, wherein the vent cover is removable from the garment.

8. A protective garment according to claim 1, wherein the protective shield members are removably attached to the lining.

9. A protective garment, comprising:

a front panel;

a rear panel joined to the front panel;

a stretchable lining underlying and peripherally attached to at least one of the front and rear panels; and one or more protective shield members attached to the lining at preselected locations and spaced from the periphery of the lining and movable with the lining relative to its overlying panel.

10. A protective garment according to claim 9, wherein at least one of the panels includes at least one vent opening for passage of air therethrough, wherein the vent opening is spanned by an air-permeable material, and wherein the lining in the vicinity of the vent opening is substantially air-permeable.

11. A protective garment according to claim 10, wherein the air-permeable material spanning the vent opening is substantially non-stretchable.

12. A protective garment according to claim 10, further comprising an adjustable air-impermeable vent cover disposed over the vent opening for controlling the passage of air through the vent opening.

13. A protective garment according to claim 12, wherein the vent cover includes an interior storage compartment.

14. A protective garment according to claim 13, wherein the vent cover is removable from the garment.

15. A protective garment according to claim 9, wherein the protective shield members are removably attached to the lining.

16. A protective garment according to claim 9, wherein the garment includes an expandable gusset between the front and rear panels.

17. A protective garment according to claim 9, wherein the garment is selected from the group consisting of jackets, vests, leggings, chaps, gloves and full body suits.

18. A protective garment, comprising:

an outer panel, and a bib panel which is adapted to engage with the outer panel with a plurality of closure elements disposed at other than the front center of the garment, wherein the bib panel is disposed in the front of the garment, and wherein engagement of the bib panel with the outer panel reduces the height, and increases the curvature, of the garment relative to the height and curvature of the garment when the bib panel and outer panel are not engaged, thereby urging a wearer of the garment into a corresponding curved profile when the garment is closed about the wearer.

19. A protective garment according to claim 18, wherein the garment is selected from the group consisting of full body suits, jackets, trousers and vests.

20. A protective garment according to claim 18, wherein the closure elements extend along respective curves on either side of the bib panel.

21. A protective garment according to claim 18, wherein the closure element is selected from the group consisting of zippers and hook and loop fasteners.

22. A protective garment according to claim 18, wherein the outer panel includes at least one vent opening for passage of air therethrough, wherein the vent opening is spanned by an air-permeable material.

23. A protective garment according to claim 22, wherein the air-permeable material spanning the vent opening is substantially non-stretchable.

24. A protective garment according to claim 23, further comprising an adjustable air-impermeable vent cover disposed over the vent opening for controlling the passage of airflow through the vent opening.

25. A protective garment according to claim 24, wherein the vent cover includes an interior storage compartment.

26. A protective garment according to claim 25, wherein the vent cover is removable from the garment.

27. A protective garment according to claim 22, further comprising a stretchable lining underlying and peripherally attached to the outer panel, and one or more protective shield members attached to the lining at preselected locations and spaced from a periphery of the panel and movable with the lining relative to the outer panel.

28. A protective garment according to claim 27, wherein the protective shield members are removably attached to the lining.

29. A protective garment according to claim 27, wherein the lining is substantially air-permeable in the vicinity of the vent openings.

* * * * *

UNITED STATES PATENT AND TRADEMARK OFFICE

CERTIFICATE OF CORRECTION

PATENT NO. : 6,070,274

DATED : June 6, 2000

INVENTOR(S) : Michael F. van der Sleesen

It is certified that error appears in the above-identified patent and that said Letters Patent are hereby corrected as shown below:

Column 4, line 20, delete "30" and insert therefor --31--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*